US006041710A

United States Patent [19]

Yasuhara

[11] Patent Number: 6,041,710

[45] Date of Patent: Mar. 28, 2000

[54] DIAGONAL IMAGE ADJUSTING DEVICE IN A PLATE CYLINDER

[75] Inventor: Yoshihiro Yasuhara, Fuchu, Japan

[73] Assignee: Ryobi Ltd., Hiroshima-ken, Japan

[21] Appl. No.: 09/224,438

[22] Filed: Dec. 31, 1998

[30] Foreign Application Priority Data

Jan. 26, 1998 [JP] Japan ..... 10-012569

[51] Int. Cl.[7] ..... B41F 13/12

[52] U.S. Cl. ..... 101/415.1; 101/DIG. 36

[58] Field of Search ..... 101/415.1, DIG. 36, 101/37 B, 408, 409, 410

[56] References Cited

U.S. PATENT DOCUMENTS

| | | | |
|---|---|---|---|
| 3,835,778 | 9/1974 | Bock | 101/415.1 |
| 3,851,583 | 12/1974 | Norton | 101/415.1 |
| 4,502,388 | 3/1985 | Ishii | 101/415.1 |
| 4,748,911 | 6/1988 | Kobler | 101/378 |
| 4,759,287 | 7/1988 | Shizuya | 101/248 |
| 5,317,968 | 6/1994 | Saitou et al. | 101/415.1 |
| 5,503,073 | 4/1996 | Bar | 101/415.1 |

*Primary Examiner*—Christopher A. Bennett
*Attorney, Agent, or Firm*—Merchant & Gould P.C.

[57] ABSTRACT

A spiral gear 7G formed on an adjusting bolt 7 is engaged with a spiral gear 8G disposed around a shaft 8 for diagonal adjustment. The shaft 8 is rotatably supported in a block 16 which is fixed to the bottom of the tail edge side clamping base 3, and the shaft 8 is screwed into the hole of a block 18 provided to a plate cylinder 60 and passes therethrough. The block 18 is supported so as not to be moved in the directions shown by the arrows 92, 93 relative to the cylinder plate 60. Diagonal image adjustment is carried out by moving the tail edge side clamping base 3 in the directions shown by the arrows 92 or 93 as a result of rotating an adjusting knob 7H of the adjusting bolt 7.

8 Claims, 10 Drawing Sheets

DIAGONAL IMAGE ADJUSTING DEVICE IN A PLATE CYLINDER

CROSS-REFERENCE TO RELATED APPLICATIONS

This application is based on Application No. Hei 10-12569 filed on Jan. 26, 1998 in Japan, the content of which is incorporated hereinto by reference.

BACKGROUND OF THE INVENTION

1. Field of the Invention

The present invention relates to a diagonal image adjusting device in a plate cylinder, more specifically, to a diagonal image adjusting device which carries out diagonal image adjustment by shifting a clamping part in a direction of a shaft of the plate cylinder.

2. Description of the Prior Art

As shown in FIG. 8, a plate 10 is rolled on a plate cylinder 60 which is used for offset printing. Offset printing is carried out by supplying both ink and dampening solution to the plate 10 which rotates together with the plate cylinder 60 rotating about a plate cylinder shaft 60J. A cut-out part 61 is formed in the plate cylinder 60, and both a leading edge side clamping base 62 and a tail edge side clamping base 63 are provided in the cut-out part 61.

A leading edge side clamp 64 is located on the leading edge side clamping base 62. A leading edge side part 10*a* of the plate 10 is clamped between the leading edge side clamping base 62 and the leading edge side clamp 64. In the same manner, a tail edge side clamp 65 is located on the tail edge side clamping base 63. A tail edge side part 10*b* of the plate 10 is clamped between the tail edge side clamping base 63 and the tail edge side clamp 65.

In a typical procedure, in order for the plate 10 to fit onto a surface of the plate cylinder 60 by applying tension, both the tail edge side clamping base 63 and the tail edge side clamp 65 are moved in a direction shown by arrow 90.

In multi-color printing, a plurality of colors are printed so as to overlay one another on a printing paper. It is, therefore, necessary to carry out an accurate register adjustment of the plate 10 to the plate cylinder 60 to achieve high quality printing as a result of preventing displacement in colors.

Diagonal image adjustment of the plate 10 on the surface of the plate cylinder 60 is difficult to carry out when the plate 10 is rolled on the plate cylinder 60 with diagonal displacement. Such diagonal displacement may be frequently observed when the leading edge side part 10*a* of a plate 10 having a short length is clamped by the leading edge side of a clamping apparatus and rolled on the plate cylinder 60.

Japanese Patent Laid-open Publication No. 193351 of 1997 (Hei 9-193351) discloses a clamping apparatus for a plate which is used for adjusting diagonal displacement of the plate 10 disposed on the plate cylinder 60. The prior art structure of the clamping apparatus will be described with reference to FIG. 9 and FIG. 10. FIG. 9 is a plan view of the plate cylinder 60, and FIG. 10 is a cross sectional view looking in the direction of arrow V of FIG. 9.

The leading edge side part 10*a* of the plate 10 is clamped between the leading edge side clamping base 62 and the leading edge side clamp 64, and the tail edge side part 10*b* of the plate 10 is clamped between the tail edge side clamping base 63 and the tail edge side clamp 65 (see FIG. 8).

Thereafter, both the tail edge side clamping base 63 and the tail edge side clamp 65 are moved in directions shown by arrow 92 or by arrow 93 with clamping of the tail edge side part 10*b* therebetween. Diagonal image adjustment of plate 10 can be carried out by the movement in the directions as a result of correcting the diagonal displacement of the plate 10 to the cylinder 60 on the surface thereof. The structure of the prior art clamping apparatus will be described hereunder.

A groove 28 extended in the directions shown by the arrows 92, 93 is formed at an end of the tail edge side clamping base 63 as shown in FIG. 9 and FIG. 10. A block 29 is inserted into the groove 28. The block 29 is slidably movable along with the groove 28 in the direction shown by the arrows 92, 93 relative to the tail edge side clamping base 63.

The block 29 is supported so as not to be moved in the directions shown by the arrows 92, 93 relative to the cylinder plate 60. An adjustment bolt 30 is screw threaded into the tail edge side clamping base 63 through a sidewall thereof. The block 29 is screw threaded and is passed through by the adjustment bolt 30.

A cut-out 30S for operation is formed in a side part of the tail edge side clamping base 63, and the end 30H of the bolt 30 protrudes in the cut-out 30S. The adjustment screw 30 can be tightened and loosened by rotating the screw 30 with a tool such as a spanner connected thereto through the cut-out 30S when the diagonal image adjustment is carried out.

A coil spring 31 is disposed around the screw 30, and the spring 31 is located between the block 29 and a side wall 36. The spring 31 prevents occurrence of backlash of the threads of the bolt 30 as well as pushing a collar 32 of the bolt into contact with the tail edge side clamping base 63.

In order to carry out diagonal image adjustment, the screw 30 is rotated with a spanner and the like. As described above, the block 29 is screw threaded and is passed through by the bolt 30, and the block 29 is supported so as not to be moved in the directions shown by the arrows 92, 93 relative to the cylinder plate 60. Consequently, the bolt 30 is moved in the directions shown by the arrows 92, 93 relative to the block 29 when the bolt 30 is tightened and loosened.

The tail edge side clamping base 63 is moved in the directions shown by the arrows 92, 93 according to the movement of the bolt 30. The diagonal image adjustment of the plate 10 is carried out as a result of moving the tail edge side clamping base 63 in the directions. The leading edge side clamping base 62 can be moved swingably around a pin 62P shown in FIG. 9. In this way, deflection of the plate 10 caused by the diagonal displacement thereof to the cylinder 60 on the surface thereof is corrected.

However, the structure of the prior art clamping apparatus have the following problems to be resolved. It takes much time and work to carry out the diagonal image adjustment because a tool such as a spanner is used to rotate the bolt 30.

Further, the use of a tool such as the spanner and the like is undesirably required to operate the bolt 30, so that the operation must be carried out indirectly. In this connection, the diagonal image adjustment can not be carried out accurately because the subtle adjustment is difficult to carry out for the indirect operation compared to direct operation by hand.

In addition, such subtle diagonal image adjustment can not be carried out with a desired accuracy since the diameter of the end 30H of the bolt 30 is relatively small. Although, occurrence of backlash of the threads of the bolt 30 is prevented by the spring 31 as described above, the tail edge side clamping base 63 tends to move a distance more than a desired range according to the rotation of the end 30H of the bolt 30 because of the diameter thereof. As a result, the diagonal image adjustment can not be carried out with the desired accuracy.

The use of another end 30H of the bolt 30 having a larger diameter might interfere with the printing work because the end 30H protrudes from an outer plane 60F (see FIG. 10) of the plate cylinder 60. In other words, the tail edge side clamping base 63 is located adjacent to the surface in order to clamp the tail edge side part 10*b* of the plate 10 between the tail edge side clamping base 63 and the tail edge side clamp 65, and the bolt 30 is provided to the tail edge side clamping base 63. Therefore, another end 30H of the bolt 30 having a larger diameter undesirably protrudes from the outer plane 60F (see FIG. 10) of the plate cylinder 60.

Further, the cut-out 30S for operation is formed at the side part of the tail edge side clamping base 63 for rotating the bolt 30. The strength of the plate cylinder adjacent to the cut-out 30S (side part) is undesirably decreased. A large sized cut-out 30S needs to be formed responding to the diameter of the end 30H of the bolt 30 when the end 30H having a larger diameter is used. As a result of forming the large sized cut-out 30S, the strength of the plate cylinder adjacent to the cut-out 30S is further decreased.

Alternatively, the strength of the plate cylinder in the side part can be maintained in a certain range when a side wall of the plate cylinder 60 is located outside of the end 30H without forming the cut-out 30S in the side wall of the tail edge side clamping base 63. The overall length of the plate cylinder 60 becomes longer than that of the original plate cylinder, so that the printing machine utilizing the plate cylinder comes to a large-scale printing machine.

OBJECTS AND SUMMARY OF THE INVENTION

It is an object of the present invention to provide a diagonal image adjusting device capable of carrying out a subtle and an accurate diagonal image adjustment, but not requiring much work for the adjustment, as well as no interference to the printing work. The diagonal image adjusting device can maintain the strength of the plate cylinder, as well as keeping compactness of the printing machine.

In accordance with characteristics of the present invention, there is provided a diagonal image adjusting device in a plate cylinder of a printing machine comprising:

a first clamping part mounted on the plate cylinder for fixing a first end of a plate, and a second clamping part mounted on the plate cylinder for fixing a second end of the plate disposed onto the surface of the plate cylinder, the second clamping part is arranged so as to form a spacing between the first clamping part, wherein the second clamping part is capable of moving in a diagonal adjustment direction which is substantially parallel to an axis of the rotating shaft of the plate cylinder, and wherein an operating part is located at a position in the spacing formed between the first clamping part and the second clamping part, and wherein the second clamping part is moved in the diagonal adjustment direction in response to an operation of the operating part.

While the novel features of the invention are set forth in a general fashion, both as to organization and content, the invention will be better understood and appreciated, along with other objects and features thereof from the following detailed description taken in conjunction with the drawings.

DESCRIPTION OF THE PREFERRED EMBODIMENT

Figure 1:
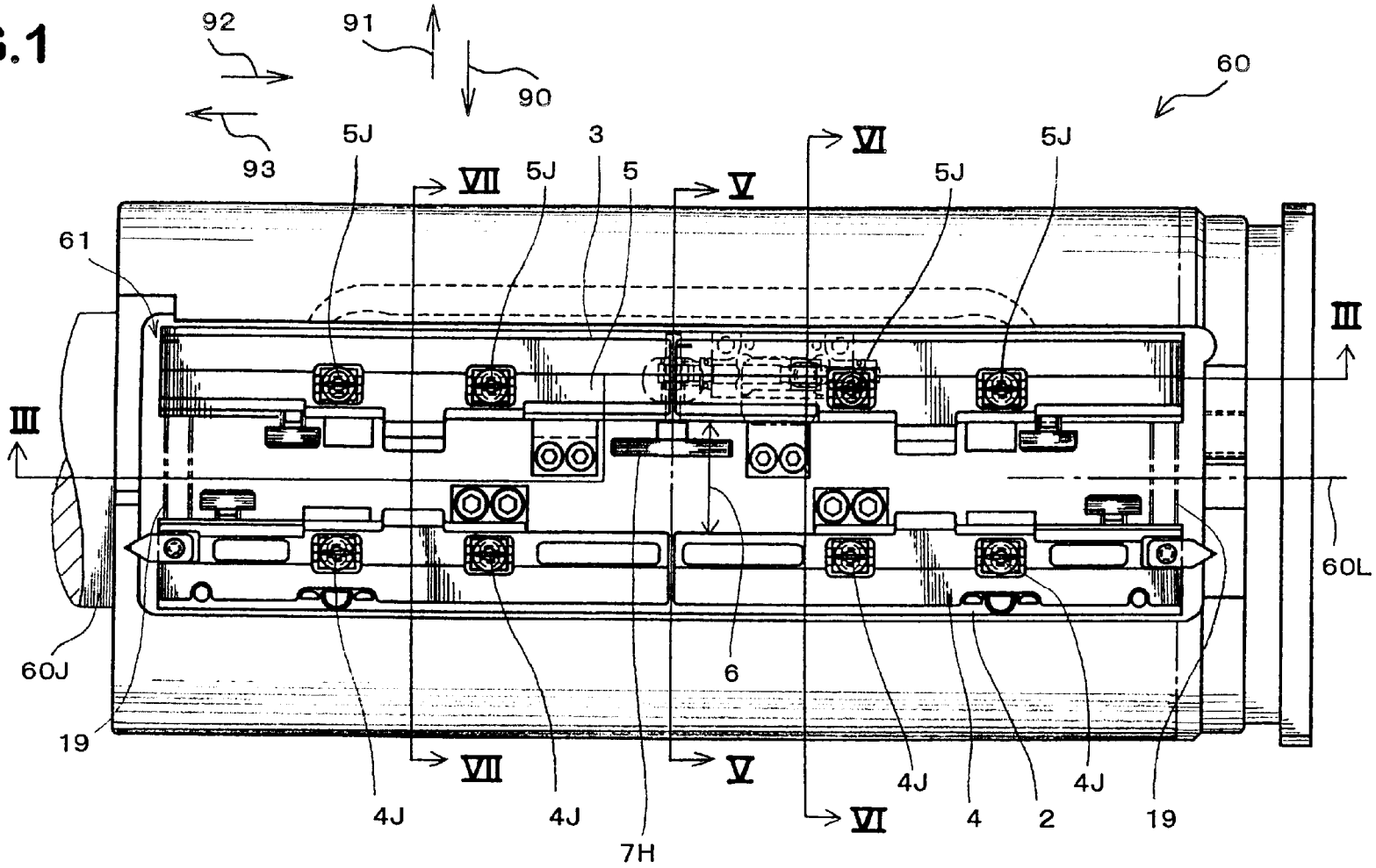
FIG. 1 is a plan view of a plate cylinder 60 showing an embodiment of a diagonal image adjusting device in the present invention.
Figure 2:
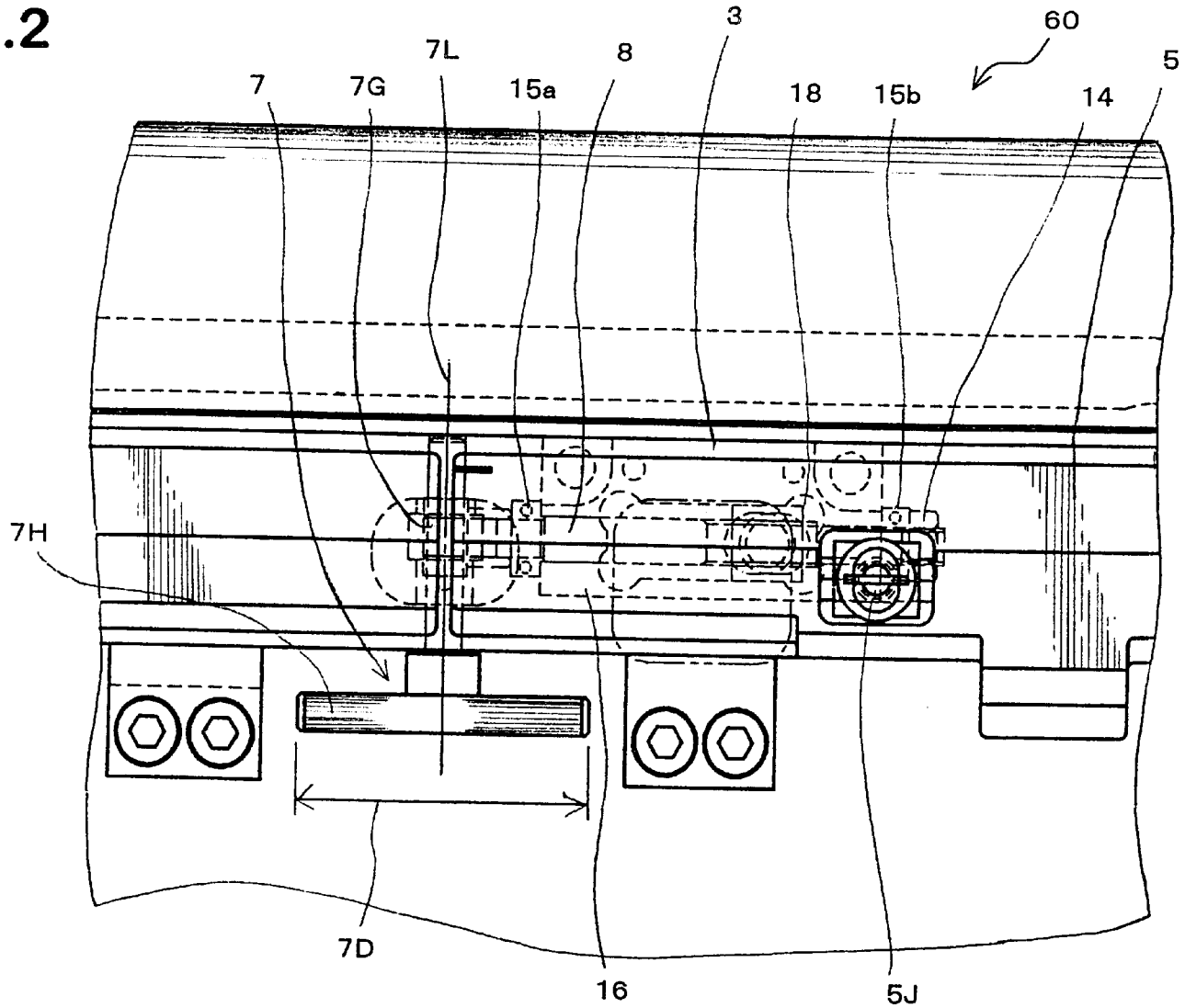
FIG. 2 is a detailed enlarged view showing the diagonal adjusting bolt 7 and vicinity thereof in FIG. 1.
Figure 3:
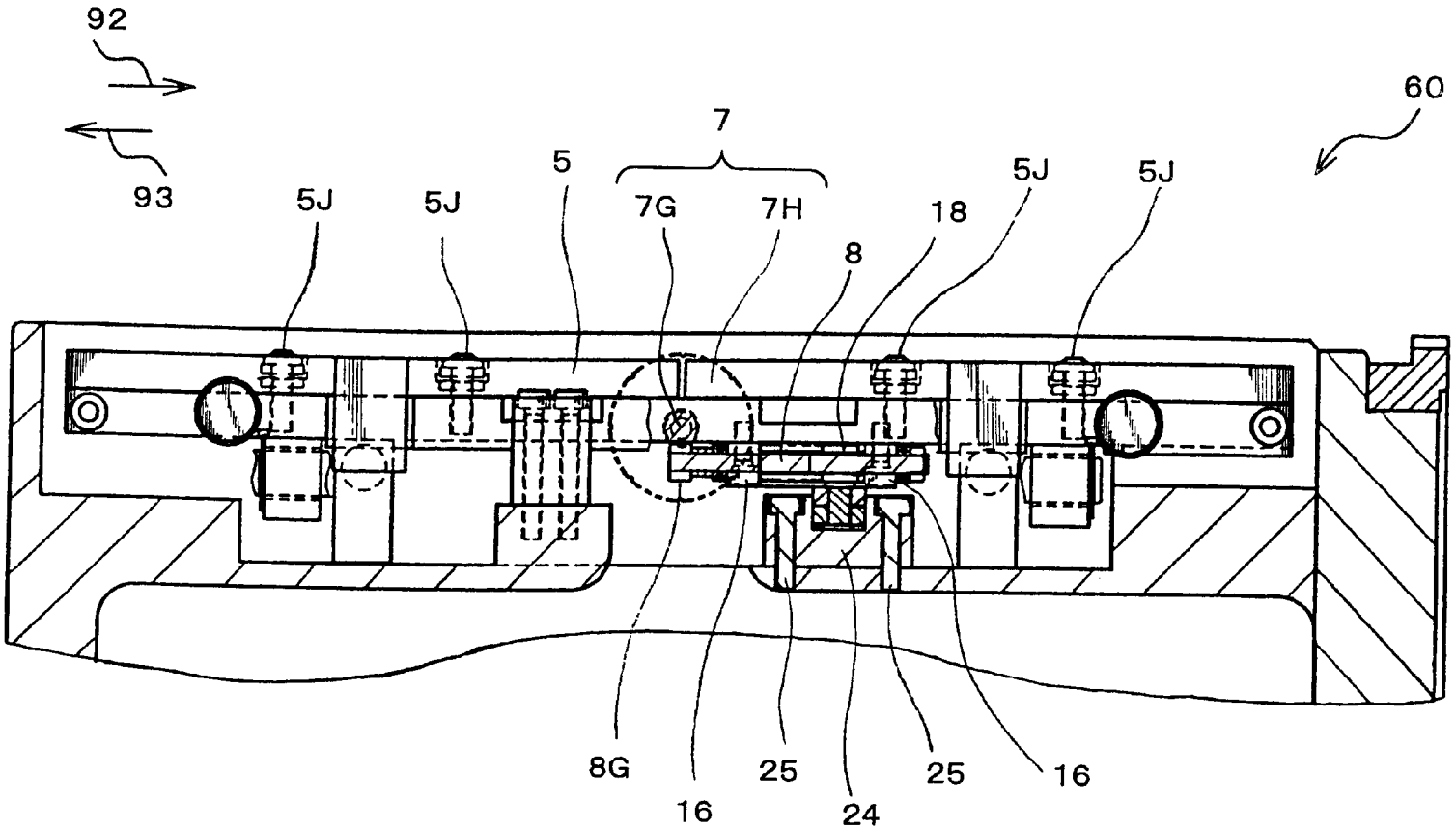
FIG. 3 is a cross sectional view taken along line III—III of FIG. 1.
Figure 4:
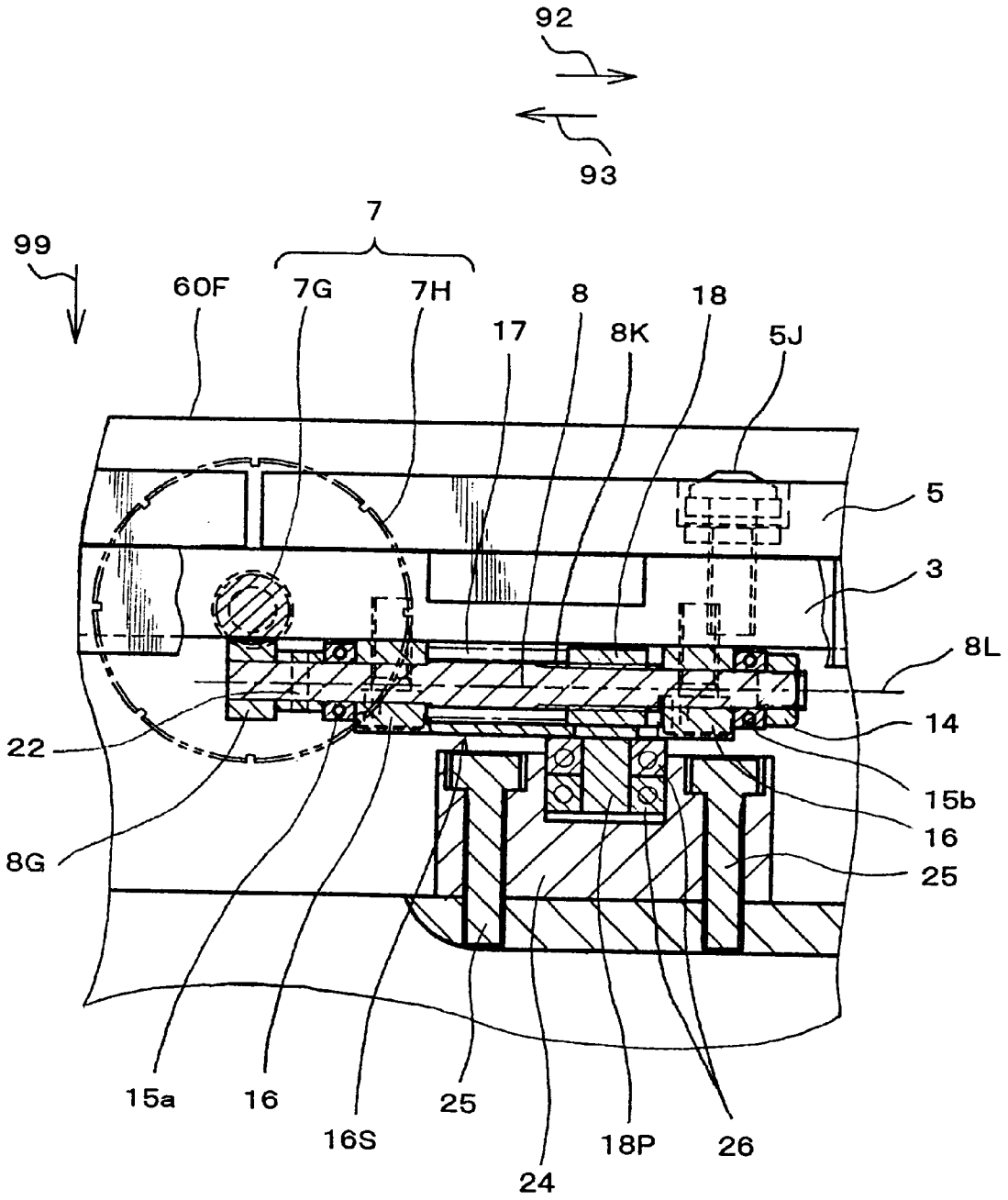
FIG. 4 is a detailed enlarged view showing the diagonal adjusting bolt 7 and vicinity thereof in FIG. 3.
Figure 5:
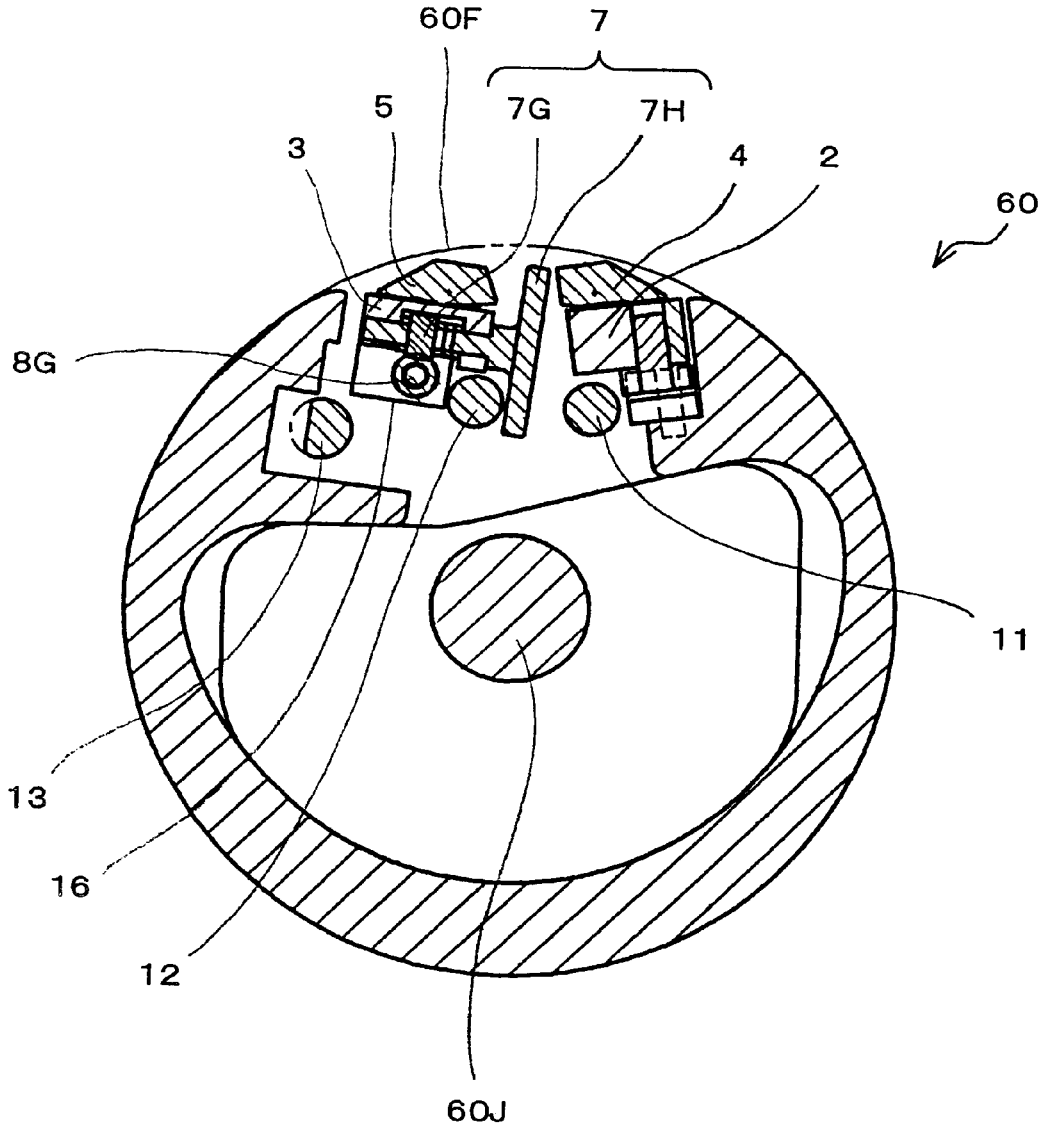
FIG. 5 is a cross sectional view taken along line V—V of FIG. 1.
Figure 6:
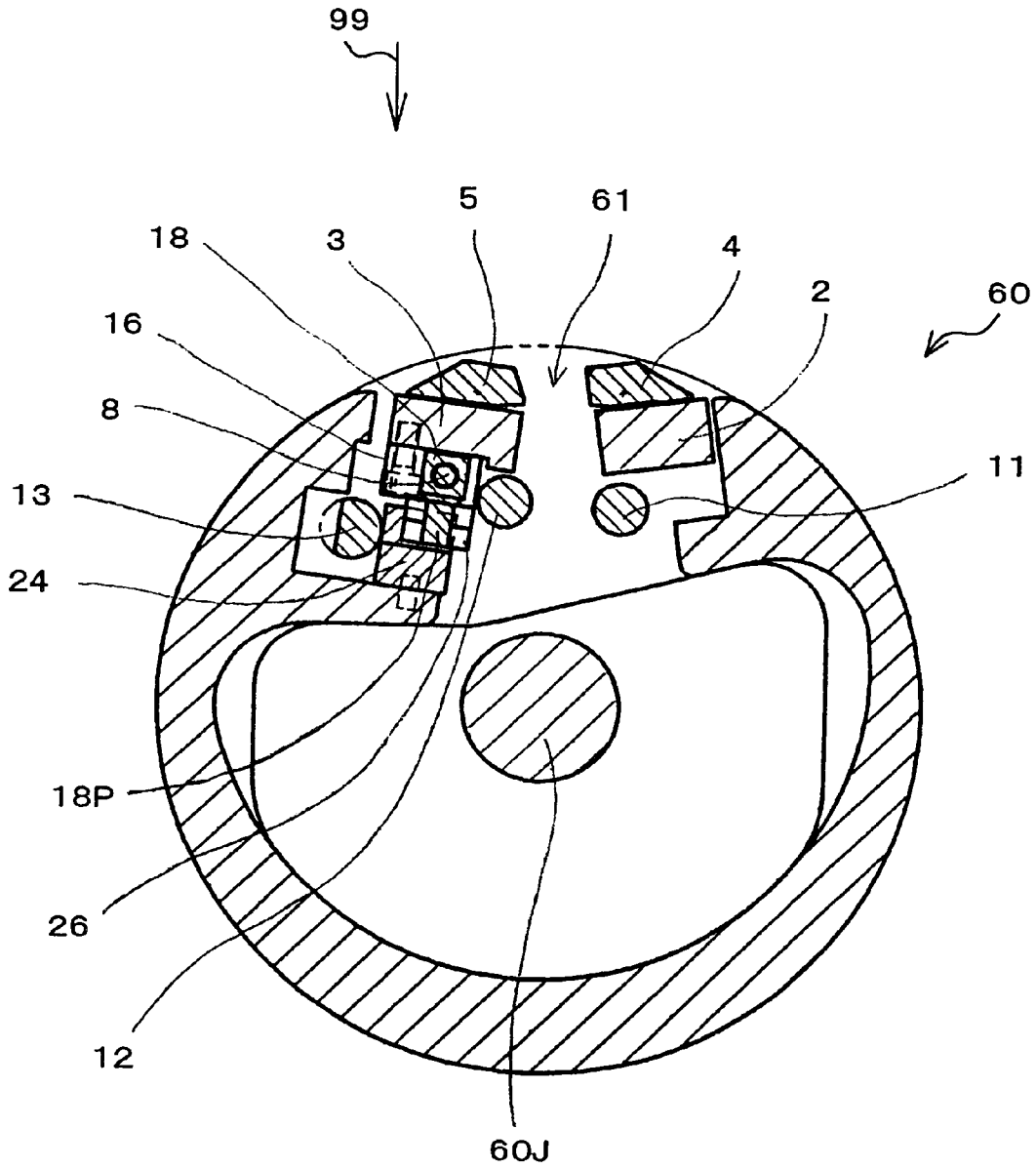
FIG. 6 is a cross sectional view taken along line VI—VI of FIG. 1.
Figure 7:
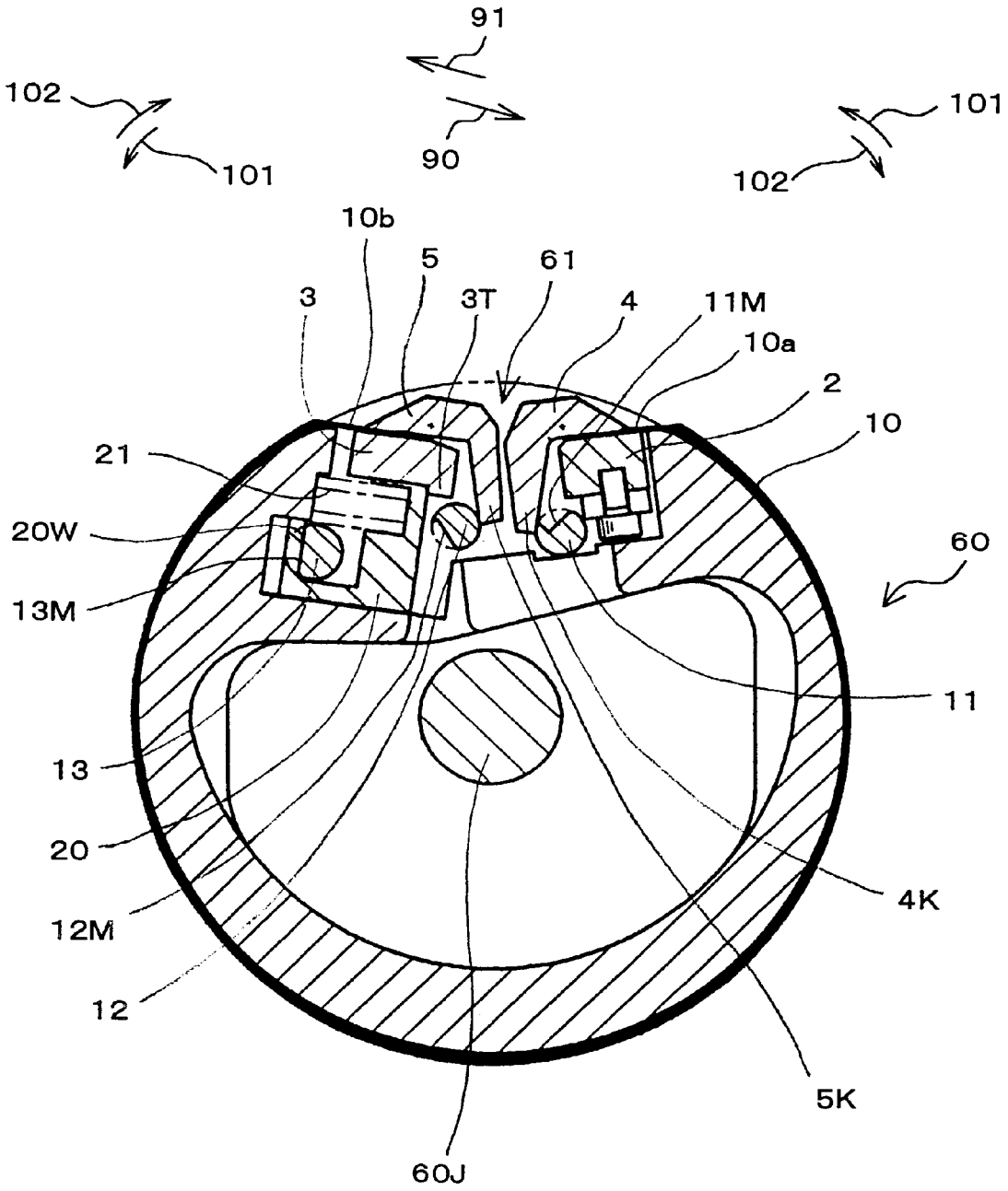
FIG. 7 is a cross sectional view taken along line VII—VII of FIG. 1.
Figure 8:
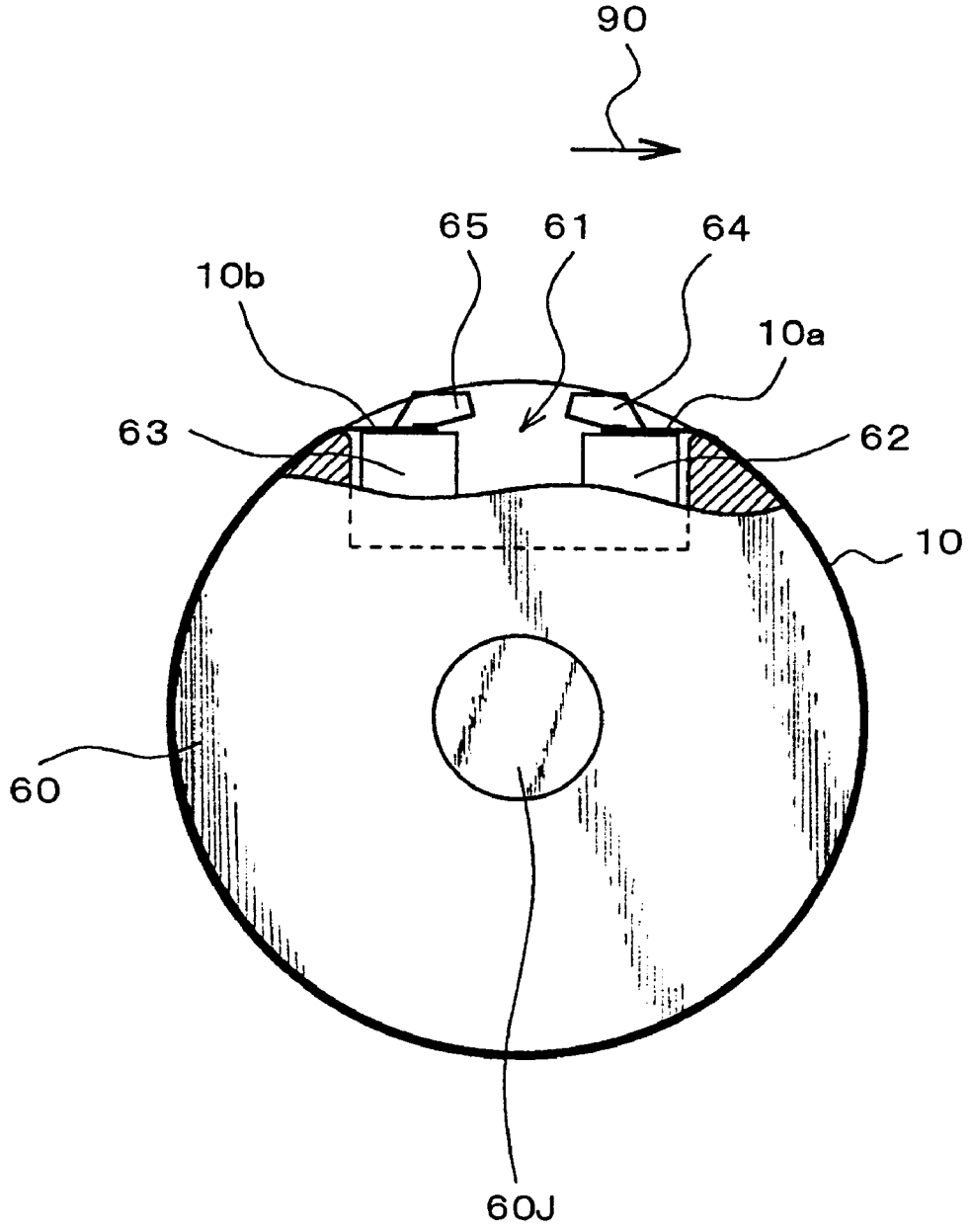
FIG.8 (PRIOR ART)
FIG. 8 is a side view showing an outline of a plate cylinder 60 used in the prior art.

An embodiment of a diagonal image adjustment device of a plate in the present invention will be described with reference to FIG. 1 through FIG. 7. FIG. 1 is a plan view of a plate cylinder 60 showing the diagonal image adjusting device in this embodiment. FIG. 2 is a detailed enlarged view showing the diagonal adjusting bolt 7 and vicinity thereof in FIG. 1. FIG. 3 is a cross sectional view taken along line I—I of FIG. 1. FIG. 4 is a detailed enlarged view showing the diagonal adjusting bolt 7 and vicinity thereof in FIG. 3. FIG. 5 is a cross sectional view taken along line II—II of FIG. 1. FIG. 6 is a cross sectional view taken along line III—III of FIG. 1. FIG. 7 is a cross sectional view taken along line IV—IV of FIG. 1.

(1) Overall structure

Both a leading edge side clamping base 2 and a tail edge side clamping base 3 are provided in a cut-out part 61 disposed in the plate cylinder 60 as shown in FIG. 7. A base spacing 6 forming a spacing is exists between the leading edge side clamping base 2 and the tail edge side clamping base 3 (see FIG. 1). Coil springs 19 are located at both ends of the base spacing 6 as shown in FIG. 1. Consequently, the leading edge side clamping base 2 is pushed in the direction of the arrow 90, and the tail edge side clamping base 3 is pushed in the direction of the arrow 91, respectively by the coil springs 19.

A leading edge side clamp 4 is provided at a position upward of the leading edge side clamping base 2. The leading edge side clamp 4 is urged to the direction of the arrow 101 (FIG. 7) by moving around a leading edge side fulcrum pin 4J. Both of the leading edge side clamping base 2 and the leading edge side clamp 4 form a first clamping part in this embodiment.

A leading edge side shaft 11 is in contact with a lower end 4*k* of the leading edge side clamp 4. The leading edge side clamp 4 is opened in the direction of the arrow 101 when the lower end 4*k* of the leading edge side clamp 4 is in contact with a cut-out plane 11M of the leading edge side shaft 11.

In order to dispose the plate 10 on the plate cylinder 60, a leading edge side part 10*a* of the plate 10 is inserted between the leading edge side clamping base 2 and the leading edge side clamp 4. Then, the lower end 4*k* of the leading edge side clamp 4 is in contact with the circumferential surface of the leading edge side shaft 11 by rotating the shaft 11. In this way, the leading edge side clamp 4 is closed in the direction of the arrow 102, so that the leading edge side part 10*a* of the plate 10 is clamped between the leading edge side clamping base 2 and the leading edge side clamp 4 as a result of closing the leading edge side clamp 4.

Further, a tail edge side clamp 5 is located at a position above of the tail edge side clamping base 3. The tail edge side clamp 5 is urged to the direction of the arrow 102 by moving around a tail edge side fulcrum pin 5J. Both of the tail edge side clamping base 3 and the tail edge side clamp 5 form a second clamping part in this embodiment.

A tail edge side shaft 12 is in contact with a lower end 5*k* of the tail edge side clamp 5. The tail edge side clamp 5 is opened in the direction of the arrow 102 when the lower end 5*k* of the tail edge side clamp 5 is in contact with a cut-out plane 12M of the tail edge side shaft 12.

After clamping the leading edge side part 10*a* of the plate 10 between the leading edge side clamping base 2 and the leading edge side clamp 4, the plate 10 is extended around and onto the surface of the plate cylinder 60. A tail edge side part 10*b* forming a second edge of the plate 10 is inserted between the tail edge side clamping base 3 and the tail edge side clamp 5. The lower end 5*k* of the tail edge side clamp 5 is in contact with the circumferential surface of the tail edge side shaft 12 by rotating the shaft 12 as shown in FIG. 7. In this way, the tail edge side clamp 5 is closed in the direction of the arrow 101, so that the tail edge side part 10*b* of the plate 10 is clamped between the tail edge side clamping base 3 and the tail edge side clamp 5 as a result of closing the tail edge side clamp 5.

Both the tail edge side clamping base 3 and the tail edge side clamp 5 are movable in the directions of the arrows 92 and 93 (diagonal image adjusting directions) substantially parallel to an axis 60L of an plate cylinder shaft 60J as shown in FIG. 1. A flange part 3T is formed on the bottom of the tail edge side clamping base 3, and the flange part 3T contacts an end surface of a spring base 20 located under the tail edge side clamping base 3. A plurality of coil springs 21 are provided in the spring base 20, and the spring base 20 is pushed in the direction of the arrow 90.

Further, a cam shaft 13 is located in the spring base 20. The tail edge side clamping base 3 is moved in the direction of the arrow 91 against the pushing force generated by the springs 21 when the circumferential surface of the cam shaft 13 is in contact with an inner wall 20W of the spring base 20. Both the leading edge side part 10*a* and the tail edge side part 10*b* of the plate 10 are clamped under a condition of moving the tail edge side clamping base 3 in the direction of the arrow 91 as described above.

A flat surface formed on the cam shaft 13 is in contact with the inner wall 20W of the spring base 20 by its rotation as shown in FIG. 7 after clamping both the leading edge side part 10*a* and the tail edge side part 10*b* of the plate 10. In this way, both the tail edge side clamping base 3 and the tail edge side clamp 5 are moved in the direction of the arrow 90 as a result of contact between the flange part 3T and the spring base 20 which receives the spring force of the springs 21. As a result of moving both the tail edge side clamping base 3 and the tail edge side clamp 5, the tail edge side part 10*b* of the plate 10 is pulled in the direction of the arrow 90, so that the plate 10 is fitted onto the surface of the plate cylinder 60.

(2) Diagonal image adjustment

Diagonal displacement of the plate 10 arises frequently when the plate 10 is disposed on the surface of the plate cylinder 60. Such diagonal displacement causes degradation of printing quality as a result of displacement in color especially in multi-color printing.

In order to prevent the displacement, both the tail edge side clamping base 3 and the tail edge side clamp 5 are moved in the directions shown by the arrows 92 or 93 under clamping of the tail edge side part 10*b* of the plate 10 therebetween. Diagonal image adjustment in which the displacement of the plate 10 in diagonal direction on the surface of the plate cylinder 60 is adjusted can be carried out as a result of the movement.

In this embodiment, diagonal image adjustment is carried out by moving both the tail edge side clamping base 3 and the tail edge side clamp 5 in the directions shown by the arrows 92 or 93 as a result of rotating an adjusting knob 7H of the adjusting bolt 7. The structure and procedure for carrying out the diagonal image adjustment will be described hereunder.

A block 16 forming a clamping side projected part is fixed to the bottom of the tail edge side clamping base 3 with bolts. The block 16 protrudes from the bottom of the tail edge side clamping base 3 so as access to the plate cylinder shaft 60J, namely in a direction of arrow 99 shown in FIG. 6. A shaft 8 for diagonal adjustment which forms a moving screw shaft pass through the block 16, and the shaft 8 is rotatably supported to the block 16. A concave part 16S is formed in the block 16 shown in FIG. 4.

A first thrust roller bearing 15*a* is disposed around the shaft 8 at its one end. A spiral gear 8G is disposed around the shaft 8 at an outer position of the first bearing 15*a*. A pin 22 is provided so as to pass through the spiral gear 8G and the shaft 8, so that the shaft 8 is rotated together with the spiral gear 8G as an united shaft.

A second thrust roller bearing 15*b* is disposed around the shaft 8 at the other end. A nut 14 is screw threaded into the shaft 8 at an outer position of the second bearing 15*b*. The shaft 8 is unable to move in the directions of the arrow 92 and the arrow 93 due to the nut 14. Jolt of the shaft 8 in the directions of the arrow 92 and the arrow 93 is reduced by hardly tightening the nut 14. Smooth rotation of the shaft 8 can be maintained by both the first thrust roller bearing 15*a* and the second thrust roller bearing 15*b* disposed at one end and the other end of the shaft 8.

A guide block 24 forming a plate cylinder side projected part is fixed to the cut-out part 61 formed in the plate cylinder 60 by fixing bolts 25. A groove extended in the direction of the arrow 90 and the arrow 91 is formed in the guide block 24, and a pin 18P of a block 18 is located in the groove. Bearings 26 are disposed around the pin 18P.

The block 18 can be moved in the directions of the arrow 90 and the arrow 91 smoothly because of the bearings 26. The block 18 is not moved in the directions of the arrow 92 and the arrow 93 because the width of the groove formed in the guide block 24 is substantially equal to the diameter of the bearings 26.

Further, a screw hole is formed in the block 18 so as the shaft 8 to pass through it, and the screw hole is located in the concave part 16S of the block 16. Screw threads 8K of the shaft 8 is screwed into the hole of the block 18 and passes through the block 18. Thus, the shaft 8 is provided so as to pass through the blocks 16 and the block 18 both forms a pair of blocks.

As shown in FIG. 4, a coil spring 17 is disposed around the shaft 8, the spring 17 is positioned between the block 18 and the block 16. The block 16 is pushed in the direction of the arrow 93 by the spring 17.

The diagonal adjusting bolt 7 forming an operating part is provided to the tail edge side clamping base 3 as shown in FIG. 5. A center axis 7L of the bolt 7 shown in FIG. 2 is directed substantially perpendicular to the axis 60L of the plate cylinder shaft 60J. The bolt 7 is held rotatably in the tail edge side clamping base 3, and a spiral gear 7G acting as an operating screw shaft is formed on the bolt 7 so as to be positioned in the tail edge side clamping base 3.

Both the spiral gear 7G of the bolt 7 and the spiral gear 8G are engaged with each other, and the shaft 8 is rotated by the rotation of the adjusting knob 7H of the adjusting bolt 7 which forms an operating head of the operating part. An axis 8L of the shaft 8 illustrated in FIG. 4 is directed so as to be substantially parallel to the axis 60L of the plate cylinder shaft 60J. The knob 7H of the adjusting bolt 7 is located within the base spacing 6.

In order to carry out diagonal image adjustment, an operator of the printing machine grips and rotates the knob 7H of the adjusting bolt 7. The rotation of the adjusting bolt 7 is conveyed to the shaft 8 through the spiral gears 7G and 8G, so that the shaft 8 is rotated in accordance with the rotation of the adjusting bolt 7. Here, the screw threads 8K of the shaft 8 is screwed into the hole of the block 18 as described earlier, and the block 18 is unable to move in the directions of the arrow 92 and the arrow 93.

Consequently, the tail edge side clamping base 3 is moved in the directions of the arrow 92 and the arrow 93 in accordance with the rotation of the knob 7H. The tail edge side part 10*b* of the plate 10 clamped between the tail edge side clamping base 3 and the tail edge side clamp 5 is moved in the directions of the arrow 92 and the arrow 93 together with the tail edge side clamping base 3. In this way, diagonal image adjustment is carried out as a result of moving the plate 10 in diagonal direction on the surface of the plate cylinder 60.

Figure 9:
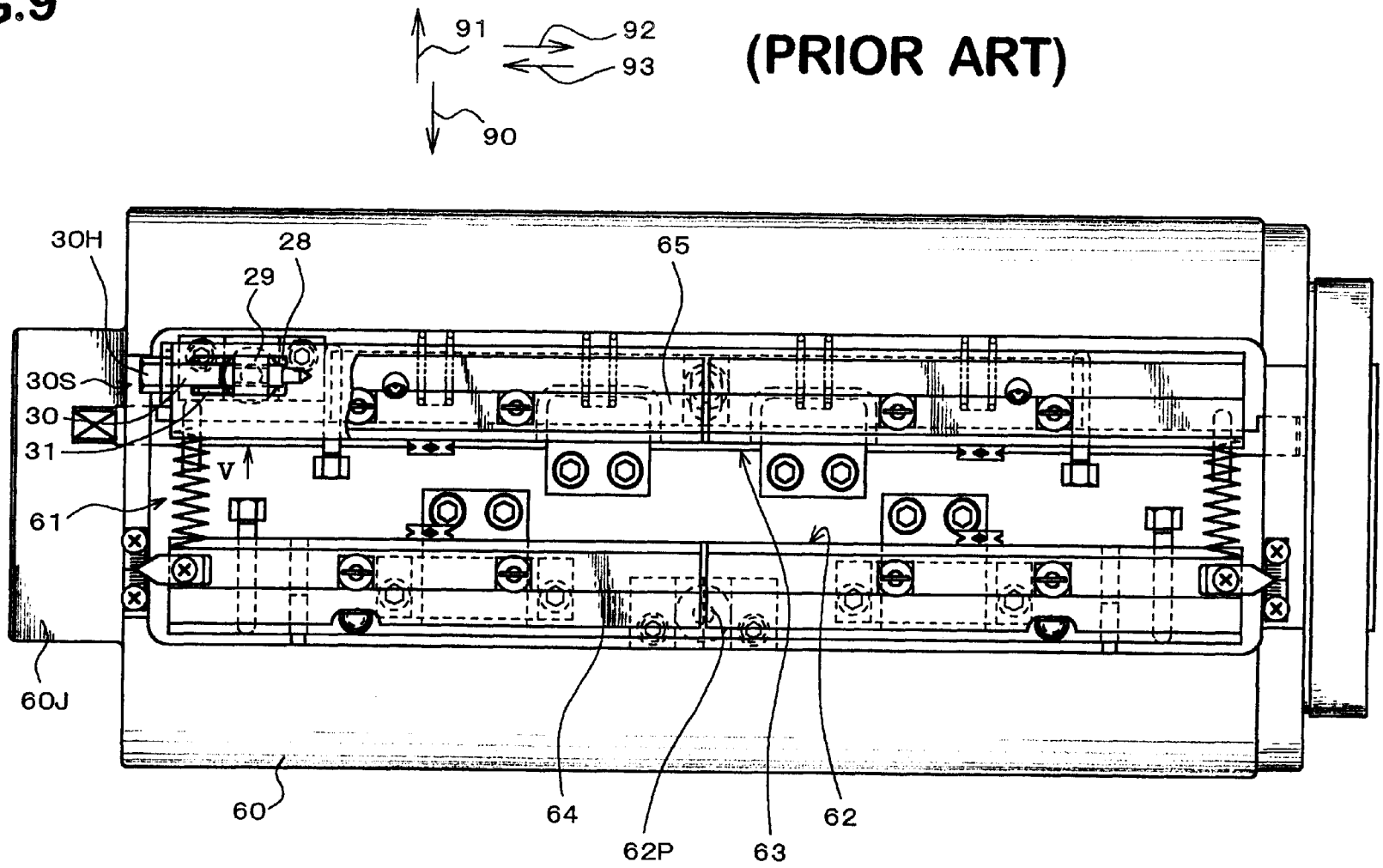
(PRIOR ART) FIG.9
FIG. 9 is a plan view of the plate cylinder 60 including a diagonal image adjusting device in the prior art clamping apparatus.

Deflection of the plate 10 caused by diagonal displacement thereof onto the surface of plate cylinder 60 is corrected because the leading edge side clamping base 2 can be moved swingably to the surface of the plate cylinder 60 similar to that of the prior art clamping apparatus (see the 62P shown in FIG. 9).

Figure 10:
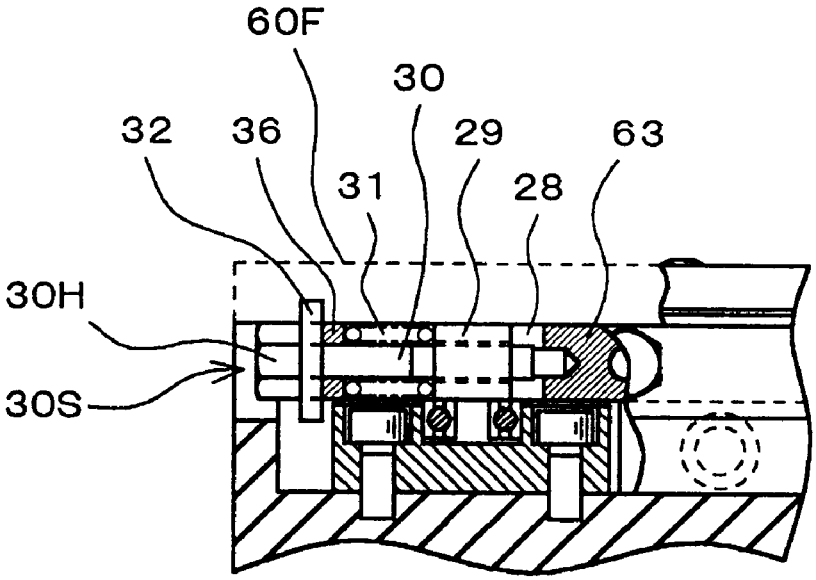
FIG.10 (PRIOR ART)
FIG. 10 is a cross sectional view looking in the direction of arrow V of FIG. 1.

It is not necessary for the diagonal image adjustment device in this embodiment to form a cut-out for operation in the clamping base similar to the cut-out 30S in the side part of the plate cylinder 60 (FIG. 10) of the prior art clamping apparatus shown in FIG. 9 and FIG. 10 because the knob 7H of the adjusting bolt 7 is located within the base spacing 6 in this embodiment. The structure leads not only to maintain the strength of the plate cylinder 60, but also helps to keep compactness of the printing machine.

Further, the block 16 protrudes from the bottom of the tail edge side clamping base 3 so as access to the plate cylinder shaft 60J (in the direction of the arrow 99), and the shaft 8 is supported to the block 16. The structure allows the shaft 8 being located at a position apart from the outer plane 60F (FIG. 4) of the plate cylinder 60, so that the adjusting bolt 7 engaged with the shaft 8 can also be located away therefrom.

Consequently, the printing work can be carried out without any interference of the knob 7H. Because the outline of the knob 7H does not extend over the outer plane 60F of the plate cylinder 60 even when the knob 7H has a relatively large diameter such as a diameter 7D shown in FIG. 2. In addition, diagonal image adjustment can be carried out by hand without requiring much work by forming the knob 7H in the diameter 7D.

Furthermore, a subtle and an accurate diagonal image adjustment can be carried out because the movement of the tail edge side clamping base 3 according to rotation of the knob 7H having a large diameter 7D can be controlled in a short range.

Moreover, the axis 8L of the shaft 8 shown in FIG. 4 and the center axis 7L of the bolt 7 are directed so as to be substantially perpendicular to each other. Consequently, the shaft 8 for moving the tail edge side clamping base 3 can be disposed along with the movement of the clamping base 3 by the rotation of the crew threads 8K, namely in the directions of the arrow 92 and the arrow 93 while the knob 7H of the adjusting bolt 7 can be disposed in a direction capable of easily rotating the bolt 7 in the base spacing 6. In this way, a diagonal image adjusting device having a high controllability with a simple structure can be obtained.

A subtle and an accurate diagonal image adjustment can be carried out because jolt of the shaft 8 in the directions of the arrow 92 and the arrow 93 is reduced by hardly tightening the nut 14 which is screw threaded into the shaft 8 at an outer position thereof. Also, the coil spring 17 disposed around the shaft 8 and between the block 16 prevents occurrence of backlash of the threads 8K. Thus, a subtle and an accurate diagonal image adjustment can be carried out.

The block 18 can be moved in the directions of the arrow 90 and the arrow 91 smoothly because of the bearings 26. In this way, the plate 10 can be fitted tightly on the plate cylinder with certain reliability because the tail edge side clamping base 3 can also be moved smoothly when the plate 10 is pulled by rotating the cam shaft 13 shown in FIG. 7.

(3) Other embodiments

The diagonal image adjusting device in accordance with the present invention is not limited to the structure described in the embodiments. Although, the bolt 7 is arranged so as to be located at substantially the center of the axis 60L of the plate cylinder shaft 60J of the plate cylinder 60 when the diagonal image adjusting device is illustrated in a plan view in the above embodiments, the bolt 7 can be located at any other positions as long as the knob 7H of the bolt 7 is located at a position in the base spacing 6.

Also, the shaft 8 for diagonal adjustment is used as a moving screw shaft in the embodiment described above, any other structure can be employed as long as the shaft 8 is provided to the clamping side projected part and the plate cylinder side projected part, both forming a pair of blocks, and the shaft 8 is arranged so as an axis thereof to be directed substantially parallel to the diagonal adjustment direction. Further, the diagonal adjusting bolt 7 is exampled as an operating part in the embodiment described above, any other structure can be employed as long as the operating part is located at a position in the spacing formed between the first clamping part and the second clamping part, and the second clamping part is moved in the diagonal adjustment direction in response to an operation of the operating part.

While the invention has been described in its preferred embodiments, it is to be understood that the words which have been used are words of description rather than limitation and that changes within the purview of the appended claims may be made without departing from the true scope and spirit of the invention in its broader aspects.

(4) Advantages of the present invention

In a diagonal image adjusting device in accordance with the present invention, the operating part is located at a position in the spacing formed between the first clamping part and the second clamping part. In other words, the operating part is not provided at a position opposed to the side wall of the plate cylinder.

It is therefore not necessary to form the cutout for operation in a side part of the plate cylinder. Therefore, the diagonal image adjusting device can maintain the strength of the plate cylinder. It is also not necessary to locate the side wall of the plate cylinder 60 outside of the operating part while securing a space for operation. Therefore, a printing machine utilizing the plate cylinder 60 may keep its compactness.

Also, in a diagonal image adjusting device in accordance with the present invention, the moving screw shaft is provided to the clamping side projected part and the plate cylinder side projected part, both forming a pair of blocks. And the clamping side projected part is fixed to the bottom of the second clamping part so as to protrude in a direction to access the rotating shaft of the plate cylinder. Namely, the clamping side projected part is located at a position apart from the surface of the plate cylinder.

Since, the moving screw shaft is provided to the clamping side projected part located at a position apart from the surface of the plate cylinder, the operating screw shaft engaged with the moving screw shaft can also be located at a position apart from the surface of the plate cylinder. Consequently, there is no probability to interfere with the printing work by the operating head because the operating part never protrudes from the surface of the plate cylinder even when the operating head of the operating part Is formed as a large-sized head in diameter.

Further, not much work is required for carrying out diagonal image adjustment because the operating head of the operating part may be adjusted manually by forming the operating head as a large-sized head in diameter. Furthermore, a subtle and accurate diagonal image adjustment can be carried out because the movement of the second clamping part according to rotation of the operating head can be controlled in a short range. In addition, the manual adjustment of the operating head leads much accurate and subtle adjustment.

Still further, the moving screw shaft is arranged so as the axis thereof is directed substantially parallel to the diagonal adjustment direction, and the axis of the operating screw shaft is directed so as to be perpendicular to the axis of the rotating shaft of the plate cylinder. Thus, the operating head can be disposed at a position so as to realize an easy-to-operate condition, so that a diagonal image adjusting device having a high controllability can be obtained.

What is claimed is:

1. A diagonal image adjusting device in a plate cylinder of a printing machine, said plate cylinder being attached to a rotating shaft, said diagonal image adjusting device being for a multi-color printing machine, comprising:

a first clamping part mounted on the plate cylinder for fixing a first end of a plate, a second clamping part mounted on the plate cylinder for fixing a second end of the plate disposed onto the surface of the plate cylinder, the second clamping part being arranged so as to form a spacing relative to the first clamping part, and an operating part located at a position in the spacing formed between the first and second clamping parts, wherein the second clamping part is capable of moving in a diagonal adjustment direction which is substantially parallel to an axis of the rotating shaft of the plate cylinder, and wherein the second clamping part moves in the diagonal adjustment direction in response to an operation of the operating part.

2. A diagonal adjusting device for a plate on a plate cylinder of a printing machine, said plate cylinder being attached to a rotating shaft, comprising:

a first clamping part mounted on the plate cylinder for fixing a first end of the plate, a second clamping part mounted on the plate cylinder for fixing a second end of the plate, said first and second clamping parts being separated to form a spacing, said second clamping part having a bottom and a clamping side projected part fixed to the bottom so as to protrude in a direction to access the rotating shaft of the plate cylinder, said second clamping part being movable in a diagonal adjustment direction substantially parallel to an axis of the rotating shaft of the plate cylinder, an operating part located at a position in the spacing formed between the first and second clamping parts, said second clamping part being movable in the diagonal adjustment direction in response to operation of the operating part, the operating part including an operating screw shaft and an operating head connected monolithis to the operating screw shaft, the operating screw shaft having an axis directed perpendicular to the axis of the rotating shaft of the plate cylinder, the operating head being located in a position in the spacing, a plate cylinder side projected part fixed to the plate cylinder, and a moving screw shaft operably arranged with respect to the clamping side projected part and the plate cylinder side projected part, both forming a pair of blocks, the moving screw shaft having an axis directed substantially parallel to the diagonal adjustment direction, the operating screw shaft and the moving screw shaft engaging with each other, the moving screw shaft rotating in response to rotation of the operating head, the second clamping part moving in the diagonal adjustment direction in response to rotation of the moving screw shaft.

3. The diagonal image adjusting device in accordance with claim 2, wherein spiral gears are formed on the operating screw shaft and the moving screw shaft respectively, and wherein the spiral gears are engaged with each other.

4. The diagonal image adjusting device in accordance with claim 2, wherein the operating head is a circular-shaped wheel.

5. The diagonal image adjusting device in accordance with claim 2, wherein the operating head is arranged so as to locate at substantially center of the axis of the rotating shaft of the plate cylinder when the diagonal image adjusting device is illustrated in a plan view.

6. The diagonal image adjusting device in accordance with claim 2, wherein a thrust ball bearing for accelerating rotation of the moving screw shaft to the clamping side projected part and the plate cylinder side projected part is disposed around the moving screw shaft.

7. The diagonal image adjusting device in accordance with claim 2, wherein a concave part is formed in one of the clamping side projected part and the plate cylinder side projected part, and wherein the other one of the clamping side projected part and the plate cylinder side projected part is engaged with the concave part.

8. The diagonal image adjusting device in accordance with claim 2, wherein a spring is positioned between the clamping side projected part and the plate cylinder side projected part.

* * * * *